US005917419A

United States Patent [19]

Beuchler

[11] Patent Number: 5,917,419

[45] Date of Patent: Jun. 29, 1999

[54] JUMPER RACK SYSTEM FOR KEEPING TRACK OF JUMPERS USED BY A RAILROAD

[76] Inventor: Keith Beuchler, N5111 County Highway S., Beaver Dam, N. Dak. 53916

[21] Appl. No.: 08/895,072

[22] Filed: Jul. 16, 1997

[51] Int. Cl.[6] ..... G08B 21/00

[52] U.S. Cl. ..... 340/687; 340/568.1

[58] Field of Search ..... 340/686.1, 687, 340/652, 568.1

[56] References Cited

U.S. PATENT DOCUMENTS 4,069,919 1/1978 Fernbaugh ..... 340/568 X
4,845,593 7/1989 Brown et al. ..... 361/192

*Primary Examiner*—Thomas Mullen
*Attorney, Agent, or Firm*—David A. Lingbeck

[57] ABSTRACT

A jumper rack system for keeping track of jumpers for a railroad includes a current conducting rack, a plurality of electrical current conducting members attached to and spaced along a support member which is fastened to a housing of the current conducting rack and having protruding portions for supporting jumpers used by a signalman. The current conducting rack is connected to an alarm unit having an alarm sounding member and light indicators, the alarm unit being connected to a power supply such as the ignition of a motor vehicle which is connected to a battery. Each current conducting member defines a jumper support. A complete circuit is formed through the current conducting rack when each jumper support is connected to an end of a respective jumper. When any jumper support is not connected to a jumper, the alarm unit will be actuated which will inform the user that a jumper is missing from the current conducting rack and that the user should check to see where the missing jumper is to avoid creating a possible dangerous situation.

17 Claims, 5 Drawing Sheets

JUMPER RACK SYSTEM FOR KEEPING TRACK OF JUMPERS USED BY A RAILROAD

BACKGROUND OF THE INVENTION

This invention relates to a jumper rack system for keeping track of jumpers used by a railroad which employs at least one signalman whose job it is to check the control signals on the tracks and at the railroad crossings to make sure that they are correctly operating so that these control signals can warn of trains either crossing roads or thoroughfares or being on particular tracks.

Many vehicle/train collisions which occur at the railroad crossings were as a result of the crossing signals not working properly such that these vehicles were driven in the path of the trains crossing the roads, and many train/train collisions which occur on the same tracks were as a result of the track signals not working properly such that both trains not knowing of the other one collided head on into each other, and it has been shown that many of these collisions could have been prevented because the signalman checking the control signals on the tracks and at the crossings with a set of jumpers failed to remove the jumpers after finishing with the checks which resulted in the control signals not being in proper operating conditions.

Signalmen are issued jumpers of which they use to do their jobs to make sure that the signals are working by simulating trains either crossing the roads or being on particular tracks which are protected with control signals. When the signalman is finished with one's test, the signalman is suppose to make sure that the control signals are put back into a ready state. Sometimes the signalman has failed to put the control signals back into a ready state which has had serious consequences. When the signalman has finished his test at one site, he may move onto another site to conduct similar tests there. If the signalman is leaving the finished test site, he may get into one's vehicle without remembering whether or not he properly removed the jumpers from the simulation and simply drive off leaving the control signals in a non-working and dangerous condition because the control signals won't indicate that a train is either on a particular track or crossing a road. To prevent potential dangerous consequences, some sort of check device or system is needed to provide substantial assurance that the signalman remembers to remove the jumpers before leaving the signal site, and that he/she can do by keeping track of all his jumpers. Applicant wasn't able to locate any prior art which would provide such a fail-safe check system.

SUMMARY OF THE INVENTION

The present invention relates to a jumper rack system for keeping track of jumpers used by a railroad which comprises an elongate current conducting rack having a dielectric housing and a plurality of spaced electrical current conducting members which have protruding end portions extending outwardly therefrom and being adapted to allow the jumpers to detachably attach thereto to form a complete circuit. The jumper rack system also includes an alarm unit having wires connected to the conducting rack and to the power supply of a motor vehicle such as a truck and further having control relays inside thereof, which serves to make or break the connections between the power supply and the alarm indicators and also between an alarm sounding member and the power supply with the alarm unit further having a momentary switch for disconnecting the electrical current to the alarm sounding member. Each signalman is given certain sets of jumpers with which to conduct controlled tests on the control signals on the railroad tracks. Sometimes the signalman has forgotten the jumpers at the control station and has left the jumpers connected to the control unit, which pre-empts the normal operations of the control signals, thus causing potentially dangerous conditions. Before the signalman leaves the control unit, he must make sure that none of the jumpers were left at the control unit especially in a condition which bypasses the effective operation of the control signals. This invention serves that purpose by reminding the signalman of missing jumpers. With all the jumpers mounted to the current conducting rack, a complete circuit is effected thus preventing one of the control relays from making the connection between the power supply and the alarm indicators. If just one jumper is not in place on the current conducting rack, the alarm indicators will be turned on. This jumper rack system reminds the signalman that he has left one or more jumpers somewhere.

One objective of the present invention is to provide a jumper rack system which sets off an alarm if any jumper is missing from the allotment of jumpers generally given to the signalman to conduct his tests of the signals.

Another objective of the present invention is to provide a jumper rack system which is used to alarm the signalman if he has left at least one pair of jumpers at the signal control structure which could be potentially catastrophic especially if the jumpers were left in a position which bypasses the effective operation of the control signals.

Yet, another objective of the present invention is to provide a jumper rack system which effectively reminds the signalman to make sure that the control signals are not being overridden with any of the jumpers once he leaves the site.

Further objectives and advantages of the present invention will become apparent as the description proceeds and when taken in conjunction with the accompanying drawings wherein:

DETAILED DESCRIPTION OF THE INVENTION

Figure 1:
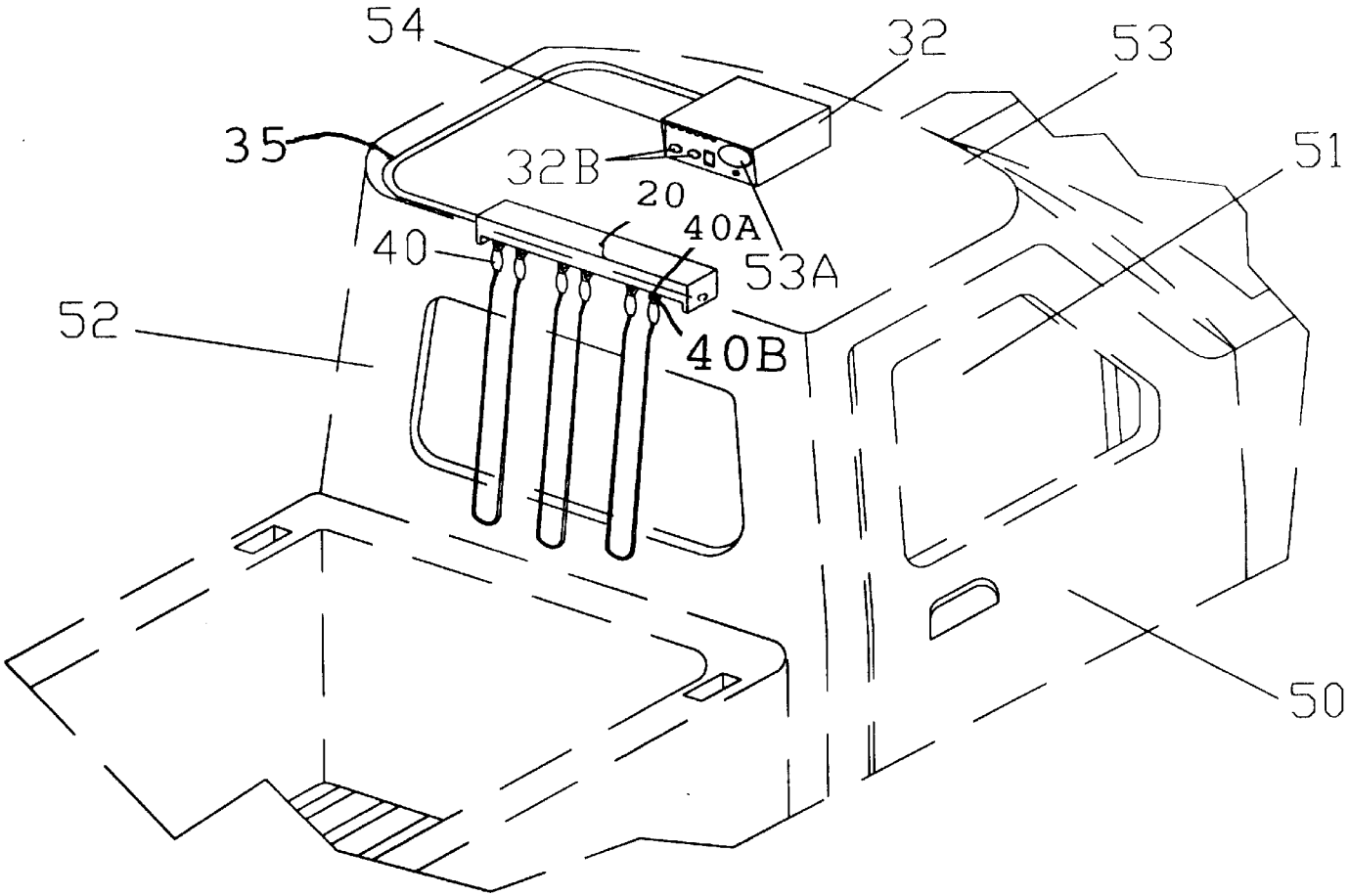
FIG. 1 is a perspective view of the jumper rack system in the passenger compartment of a vehicle.
Figure 2:
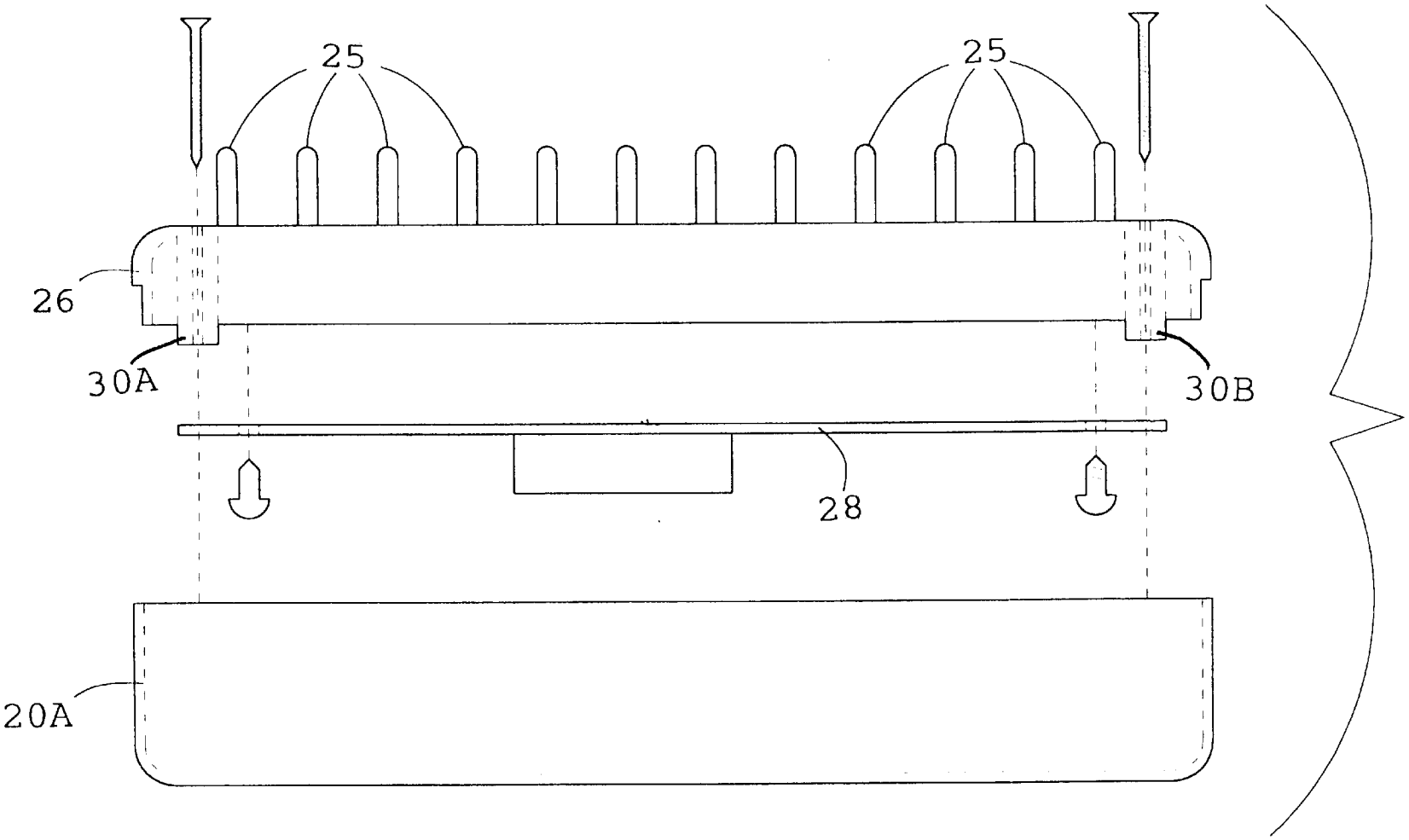
FIG. 2 is an exploded edge elevational view of the jumper rack system.
Figure 3:
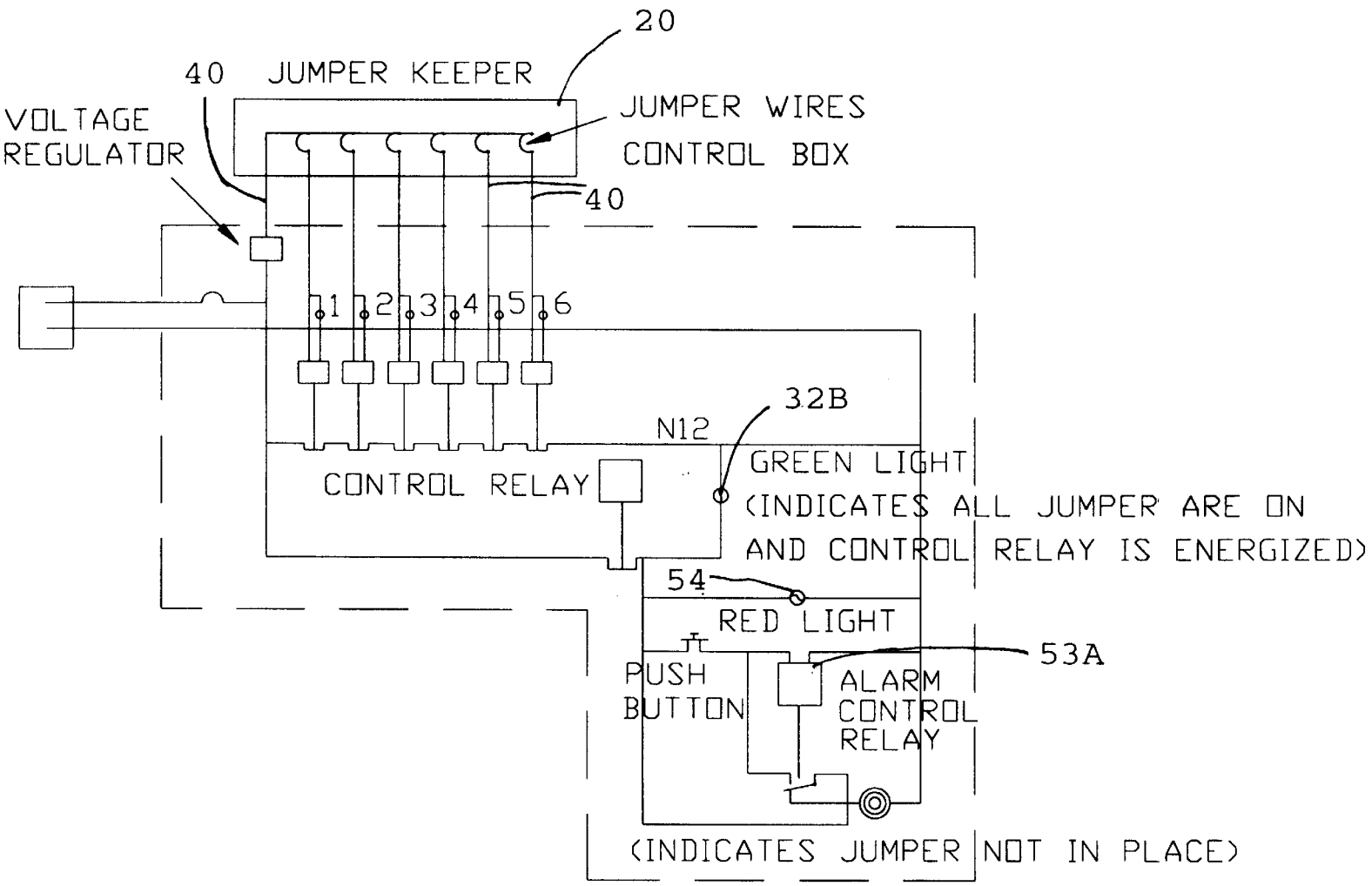
FIG. 3 is a schematic diagram of the jumper rack system.
Figure 4:
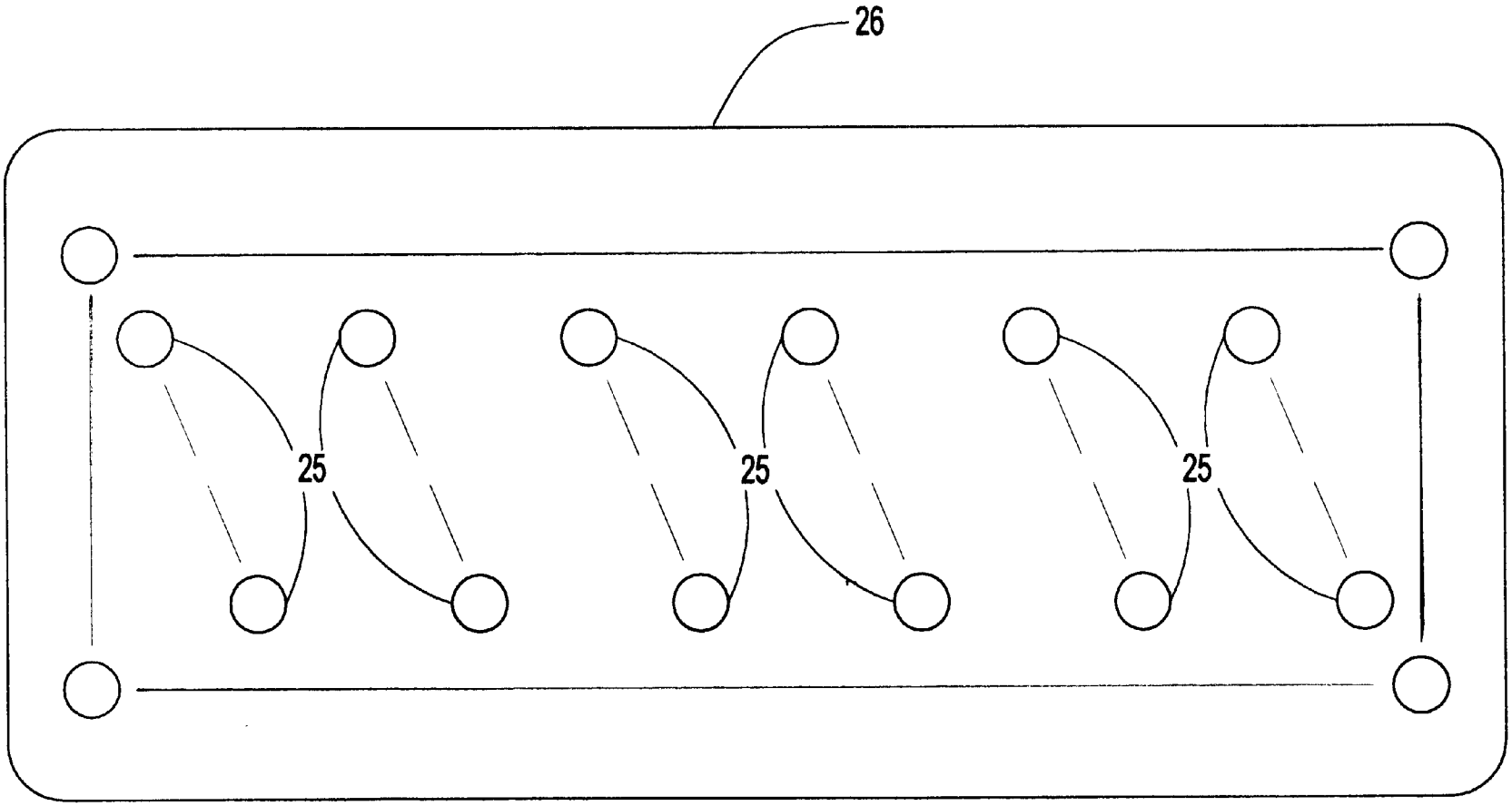
FIG. 4 is a side elevational view of the jumper rack system showing in particular the support member for the plurality of current conducting posts.
Figure 5:
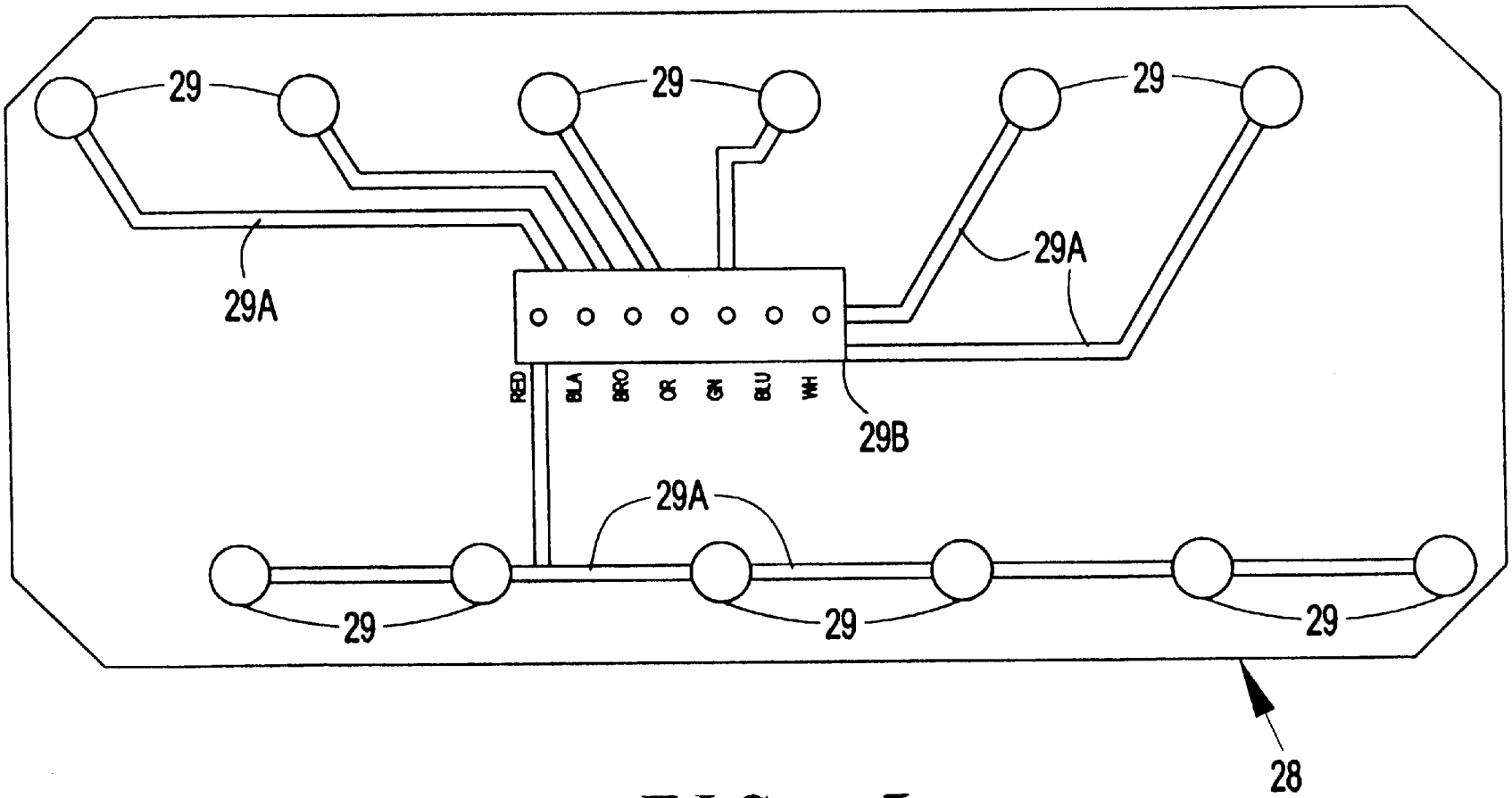
FIG. 5 is side elevational view of the jumper rack system showing in particular the circuit board for managing circuits.

Referring to FIGS. 1–5, in particular, the jumper rack system for keeping track of jumpers used by a railroad comprises a current conducting rack 20 having an elongate dielectric housing 20A having a main wall and a pair of end walls with a hole through each thereof for mounting to a pair of brackets (not shown) which are mounted to a structure, in particular, to the back wall 52 inside the passenger compartment 51 of a motor vehicle 50. The jumper rack system further comprises a plurality of electrical current conducting members 25 which includes a plurality of pairs of current conducting posts which are attached to a planar support member 26 which is fastened to the dielectric housing 20A with conventional means, the current conducting posts 25 protruding outwardly from a side of the planar support member 26 and protruding through a plurality of holes 29 arranged through a printed circuit board 28, the current conducting posts 25 also being in contact with the printed circuit board 28 which comprises a terminal strip 29B and a plurality of conventional current connectors 29A extending between the holes 29 and the terminal strip 29B which is the control center, the printed circuit board 28 also overlaying the side of the planar support member 26. The current conducting posts 25 in each pair are spaced from each other with one current conducting post 25 of each pair thereof being disposed near and arranged in a row along one longitudinal edge of the planar support member 26 and with the other current conducting post from each pair thereof being disposed near and arranged in a row along the opposite longitudinal edge of the planar support member 26. The current conducting posts 25 in each pair are spacedly skewed from one another. Each current conducting post is used to support one end of a set of jumpers 40 and essentially defines a jumper support for one end of the jumper 40, which normally has a clip member which has two conventional opposed jaws 40A–B each having serrated teeth for gripping an object and both being biased toward one another; whereas, the other current conducting post in each pair is used to support the other end of a set of jumpers 40 to complete the circuit.

A pair of current conducting terminals 30A–B extend through the dielectric housing into the current conducting members 25 and are connected to protective tubular-encased wires 35 which are connected to an alarm unit 32 to indicate whether or not all the jumpers 40 are on the current conducting rack 20. The alarm unit 32 is connected by a protective tubular-encased wire to the ignition of the motor vehicle 50 such that when the ignition is turned on, electrical current from the battery of the vehicle goes to the alarm unit 32 and to the current conducting rack 20. If all the jumpers 40 are in place on the current conducting rack 20, that is if they are connected to all the jumper supports to effect a complete circuit through the current conducting rack 20, the electrical current from the power supply will pass through the current conducting rack 20 and back to the alarm unit 32 which houses a first control relay which serves to break the connections of the circuit to the alarm indicators 32B,53A, 54 which includes light indicators 54 such as a light indicator for each missing jumper 40 and an alarm sounding member 53A, and which houses a second control relay which serves to break the circuit to the alarm sounding member 53A. The alarm unit 32 further includes a momentary switch which is connected to the second control relay and which allows the user to turn off the alarm sounding member 53A. The alarm unit 32 is mounted within reach of the driver of the motor vehicle 50, in particular, it is mounted above the windshield 53 to the passenger compartment 51 with fastening members.

In operation, each set of jumpers 40 has clip members at the ends thereof for clamping to respective current conducting posts 25 on the current conducting rack 20 which should have an even number of jumper supports 25A–B so that each clip member for any particular jumper 40 can be connected to the current conducting rack 20 to effect a complete circuit through the current conducting rack 20. If any clip member of a jumper 40 is not attached to the current conducting rack 20, the circuit will be broken and opened and electrical current will be prevented from passing through the current conducting rack 20, thus causing the first control relay in the alarm unit 32 to make the connection between the power source or battery and the alarm indicators 53A,54, resulting in the alarm indicators 53A,54 going off and signalling that there is at least one missing jumper 40.

Each signalman is issued a certain number of jumpers 40 of which he/she uses to simulate and conduct tests of the control signals along the railroad tracks and at railroad crossings at the control structures. If the signalman, upon completing the test, fails to remove the jumpers 40 from bypassing the normal operations of the control signals, the control signals won't operate properly when called upon to do so, thus creating a very dangerous situation. If this happens, the control signals at the railroad crossings won't respond to a train on the tracks.

The jumper rack system serves to remind the signalman to remove the jumpers 40 from the control structure before leaving the site. All of the jumpers used by the signalman must be attached to the current conducting rack 20 when he starts his motor vehicle 50; otherwise, the alarm indicators 53A,54 will be actuated. Both clips of each set of jumpers 40 must be connected to the respective current conducting posts 25 to complete the circuit through the current conducting rack 20. If not, the circuit will be broken through the current conducting rack 20 and electrical current won't be able to pass therethrough, thus causing the first control relay to make the connection between the power supply and the alarm indicators 53A,54, thus setting off the alarm indicators 53A,54. As long as all sets of jumpers 40 are properly connected or attached to the respective current conducting posts 25 on the current conducting rack 20, the circuit through the current conducting rack will be complete, thus allowing electrical current to pass through the current conducting rack 20 and preventing the first control relay from making the connection between the power supply and the alarm indicators 53A,54. If the alarm indicators 53A,54 are actuated because of a missing jumper 40, the alarm sounding member 53A or horn can be turned off by the user depressing the momentary switch which causes the second control relay to break the connection between the power supply and the alarm sounding member 53A. The alarm indicator lights 54 will still be glowing to indicate that at least one of the jumpers 40 is missing or is not properly attached to the respective current conducting posts 25; that is, the opposed jaws 40A–B of at least one of the clip members are not engaged to a respective two adjacent protruding end portions to effect a complete circuit through the current conducting rack 20. This system could potentially save many lives and prevent millions of dollars in property losses due to preventable crashes.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A jumper rack system for keeping track of jumpers used by a railroad comprising:

a current conducting rack including a plurality of pairs of electrical current conducting members and a circuit board for managing circuits, each of said current conducting members having at least a portion protruding from said current conducting rack, to which a jumper can be removably attached;

and an alarm unit connected to said current conducting rack with wires and connected to a power supply also with wires, said alarm unit being actuated if a circuit through said current conducting rack is broken because of a jumper not being attached thereto.

2. A jumper rack system for keeping track of jumpers used by a railroad as described in claim 1, wherein said electrical conducting members of a respective one of said pair of electrical current conducting members are spacedly arranged relative to each other.

3. A jumper rack system for keeping track of jumpers used by a railroad as described in claim 2, wherein a plurality of said electrical current conducting members include a plurality of pairs of current conducting posts, each said current conducting post being adapted for supporting an end of a set of jumpers.

4. A jumper rack system for keeping track of jumpers used by a railroad as described in claim 3, wherein each of said current conducting posts in a respective one of said of pairs of current conducting posts are spacedly skewed from each other.

5. A jumper rack system for keeping track of jumpers used by a railroad as described in claim 3, wherein said circuit board includes a plurality of holes adapted for receiving said current conducting posts which are in contactable relationship with said circuit board, and further includes a terminal strip and a plurality of current conducting connectors.

6. A jumper rack system for keeping track of jumpers used by a railroad as described in claim 5, wherein said current conducting rack further includes a support member for supporting said plurality of current conducting posts.

7. A jumper rack system for keeping track of jumpers used by a railroad as described in claim 6, wherein said plurality of current conducting posts are arranged in rows along said support member.

8. A jumper rack system for keeping track of jumpers used by a railroad as described in claim 7, wherein said current conducting rack further includes a pair of terminals through which electrical current can pass, each of said terminals being in contact with said electrical current conducting members, said terminals being connected to said wires which are connected to said alarm unit.

9. A jumper rack system for keeping track of jumpers used by a railroad as described in claim 8, wherein said alarm unit includes a first control relay and alarm indicators, said first control relay making or breaking a connection between said alarm indicators and said power supply depending upon whether an electrical current was able to pass through said current conducting rack upon being energized.

10. A jumper rack system for keeping track of jumpers used by a railroad as described in claim 9, wherein said alarm indicators include an alarm sounding member and at least one light indicator which are actuated if any of said current conducting members is not connected to an end of any of said jumpers upon said current conducting rack being energized.

11. A jumper rack system for keeping track of jumpers used by a railroad as described in claim 10, wherein said alarm unit further includes a second control relay and a switch for deactivating said alarm sounding member when actuated.

12. A jumper rack system for keeping track of jumpers used by a railroad as described in claim 10, wherein said at least one light indicator is exposed from said alarm unit, said at least one light indicator being actuated upon said circuit through said current conducting rack is broken.

13. A process of keeping track of jumpers for a railroad comprises the steps of:

providing a current conducting rack including a plurality of current conducting posts for supporting ends of jumpers;

connecting said current conducting rack to an alarm unit;

connecting said alarm unit to a power supply of a motor vehicle;

energizing said current conducting rack; and responding to any alarm indicators of said alarm unit because of a jumper not being attached to said current conducting rack.

14. A process of keeping track of jumpers for a railroad as described in claim 13, wherein said step of providing said current conducting rack further includes the step of mounting said current conducting rack inside a passenger compartment of said motor vehicle.

15. A process of keeping track of jumpers for a railroad as described in claim 13, wherein each of said current conducting posts define respective current conducting members.

16. A process of keeping track of jumpers for a railroad as described in claim 15, wherein said step of responding to said alarm indicators of said alarm unit further includes the step of attaching all said jumpers to said plurality of current conducting members to effect a complete circuit through said current conducting rack thus deactivating said alarm indicators.

17. A process of keeping track of jumpers for a railroad as described in claim 16, wherein the step of attaching all said jumpers to said plurality of current conducting members further includes attaching each end of said jumpers to a respective one of said current conducting members to effect a complete circuit through said current conducting rack thus deactivating said alarm indicators.

* * * * *